US011478021B2

(12) United States Patent
Bowen et al.

(10) Patent No.: US 11,478,021 B2
(45) Date of Patent: Oct. 25, 2022

(54) SYSTEMS AND METHODS FOR AEROSOLIZING A VAPORIZABLE MATERIAL

(71) Applicant: JUUL LABS, INC., San Francisco, CA (US)

(72) Inventors: Adam Bowen, San Francisco, CA (US); James Monsees, San Francisco, CA (US)

(73) Assignee: JUUL Labs, Inc., San Francisco, CA (US)

( * ) Notice: Subject to any disclaimer, the term of this patent is extended or adjusted under 35 U.S.C. 154(b) by 451 days.

(21) Appl. No.: 15/309,554

(22) PCT Filed: May 15, 2015

(86) PCT No.: PCT/US2015/031152
§ 371 (c)(1),
(2) Date: Nov. 8, 2016

(87) PCT Pub. No.: WO2015/175979
PCT Pub. Date: Nov. 19, 2015

(65) Prior Publication Data

US 2017/0181468 A1 Jun. 29, 2017

Related U.S. Application Data

(60) Provisional application No. 61/994,787, filed on May 16, 2014.

(51) Int. Cl.
*A24F 42/10* (2020.01)
*A24F 40/42* (2020.01)
(Continued)

(52) U.S. Cl.
CPC ..... *A24F 42/10* (2020.01); *A24D 1/20* (2020.01); *A24F 40/42* (2020.01); *A24F 42/60* (2020.01)

(58) Field of Classification Search
CPC .. A24F 47/00–008; A24F 40/42; A24F 23/02; A24F 40/46; A24D 1/14; A61M 15/06; A24B 13/00
See application file for complete search history.

(56) References Cited

U.S. PATENT DOCUMENTS 374,584 A 12/1887 Cook
576,653 A 2/1897 Bowlby
(Continued)

FOREIGN PATENT DOCUMENTS

CA 2641869 A1 5/2010
CN 85106876 A 9/1986
(Continued)

OTHER PUBLICATIONS

Baker et al.; The pyrolysis of tobacco ingredients; J. Anal. Appl. Pyrolysis; 71(1); pp. 223-311; Mar. 2004.
(Continued)

*Primary Examiner* — Michael J Felton
*Assistant Examiner* — Yana B Krinker
(74) *Attorney, Agent, or Firm* — Mintz Levin Cohn Ferris Glovsky and Popeo, P.C.

(57) ABSTRACT

A smoking device for generating and releasing smoking vapor free from contamination into the mouth of a user comprising a mouthpiece for providing vapor for inhalation to a user including a tubular casing containing a heater for heating a smoking substance at a substantially constant low temperature by regulating the flow of fuel by a thermal regulator and further having means for visual indication of the operation of the device.

33 Claims, 5 Drawing Sheets

(51) Int. Cl.
*A24D 1/20* (2020.01)
*A24F 42/60* (2020.01)

(56) References Cited

U.S. PATENT DOCUMENTS 595,070 A 12/1897 Oldenbusch
720,007 A 2/1903 Dexter
799,844 A 9/1905 Fuller
968,160 A 8/1910 Johnson
969,076 A 8/1910 Pender
1,067,531 A 7/1913 MacGregor
1,163,183 A 12/1915 Stoll
1,299,162 A 4/1919 Fisher
1,505,748 A 8/1924 Louis
1,552,877 A 9/1925 Phillipps et al.
1,632,335 A 6/1927 Hiering
1,706,244 A 3/1929 Louis
1,845,340 A 2/1932 Ritz
1,972,118 A 9/1934 McDill
1,998,683 A 4/1935 Montgomery
2,031,363 A 2/1936 Elof
2,039,559 A 5/1936 Segal
2,104,266 A 1/1938 McCormick
2,159,698 A 5/1939 Harris et al.
2,177,636 A 10/1939 Coffelt et al.
2,195,260 A 3/1940 Rasener
2,231,909 A 2/1941 Hempel
2,327,120 A 8/1943 McCoon
2,460,427 A 2/1949 Musselman et al.
2,483,304 A 9/1949 Rudolf
2,502,561 A 4/1950 Ludwig
2,765,949 A 10/1956 Swan
2,830,597 A 4/1958 Jakob
2,860,638 A 11/1958 Frank
2,897,958 A 8/1959 Tarleton et al.
2,935,987 A 5/1960 Ackerbauer
3,146,937 A 9/1964 Joseph
3,258,015 A 6/1966 Ellis et al.
3,271,719 A 9/1966 Ovshinsky
3,292,634 A 12/1966 Beucler
3,373,915 A 3/1968 Anderson et al.
3,420,360 A 1/1969 Young
3,443,827 A 5/1969 Acker et al.
3,456,645 A 7/1969 Brock
3,479,561 A 11/1969 Janning
3,567,014 A 3/1971 Feigelman
3,675,661 A 7/1972 Weaver
3,707,017 A 12/1972 Paquette
3,792,704 A 2/1974 Parker
3,815,597 A 6/1974 Gottelman
3,861,523 A 1/1975 Fountain et al.
3,941,300 A 3/1976 Troth
4,020,853 A 5/1977 Nuttall
4,049,005 A 9/1977 Hernandez et al.
4,066,088 A 1/1978 Ensor
4,207,976 A 6/1980 Herman
4,215,708 A 8/1980 Bron
4,219,032 A 8/1980 Tabatznik et al.
4,303,083 A 12/1981 Burruss
4,506,683 A 3/1985 Cantrell et al.
4,519,319 A 5/1985 Howlett
4,595,024 A 6/1986 Greene et al.
4,648,393 A 3/1987 Landis et al.
4,708,151 A * 11/1987 Shelar ..... A24D 1/14 131/359
4,735,217 A 4/1988 Gerth et al.
4,771,796 A 9/1988 Myer
4,793,365 A 12/1988 Sensabaugh, Jr. et al.
4,794,323 A 12/1988 Zhou et al.
4,798,310 A 1/1989 Kasai et al.
4,813,536 A 3/1989 Willis
4,819,665 A 4/1989 Roberts et al.
4,830,028 A 5/1989 Lawson et al.
4,836,224 A 6/1989 Lawson et al.
4,846,199 A 7/1989 Rose
4,848,374 A 7/1989 Chard et al.
4,848,563 A 7/1989 Robbins
4,893,639 A 1/1990 White
4,907,606 A 3/1990 Lilja et al.
4,941,483 A 7/1990 Ridings et al.
4,944,317 A 7/1990 Thal
4,947,874 A 8/1990 Brooks et al.
4,947,875 A 8/1990 Brooks et al.
5,005,759 A 4/1991 Bouche
5,020,548 A 6/1991 Farrier et al.
5,027,836 A 7/1991 Shannon et al.
5,031,646 A 7/1991 Lippiello et al.
5,042,509 A * 8/1991 Banerjee ..... A24F 47/004 131/71
5,050,621 A 9/1991 Creighton et al.
5,060,671 A 10/1991 Counts et al.
5,065,776 A 11/1991 Lawson et al.
5,076,297 A 12/1991 Farrier et al.
5,105,831 A 4/1992 Banerjee et al.
5,105,838 A 4/1992 White et al.
5,123,530 A 6/1992 Lee
5,133,368 A 7/1992 Neumann et al.
5,144,962 A 9/1992 Counts et al.
5,152,456 A 10/1992 Ross et al.
5,183,062 A 2/1993 Clearman et al.
5,224,498 A 7/1993 Deevi et al.
5,240,012 A 8/1993 Ehrman et al.
5,249,586 A * 10/1993 Morgan ..... A24B 15/14 131/194
5,261,424 A 11/1993 Sprinkel, Jr.
5,269,237 A 12/1993 Baker et al.
5,269,327 A 12/1993 Counts et al.
5,303,720 A 4/1994 Banerjee et al.
5,322,075 A 6/1994 Deevi et al.
5,372,148 A 12/1994 McCafferty et al.
5,388,574 A 2/1995 Ingebrethsen
5,456,269 A 10/1995 Kollasch
5,497,791 A 3/1996 Bowen et al.
5,529,078 A 6/1996 Rehder et al.
5,591,368 A 1/1997 Fleischhauer et al.
5,605,226 A 2/1997 Hernlein
5,641,064 A 6/1997 Goserud
5,649,552 A 7/1997 Cho et al.
5,666,977 A 9/1997 Higgins et al.
5,666,978 A 9/1997 Counts et al.
5,708,258 A 1/1998 Counts et al.
5,730,118 A 3/1998 Hermanson
5,730,158 A 3/1998 Collins et al.
5,746,587 A 5/1998 Racine et al.
5,810,164 A 9/1998 Rennecamp
5,819,756 A 10/1998 Mielordt
5,845,649 A 12/1998 Saito et al.
5,865,185 A 2/1999 Collins et al.
5,881,884 A 3/1999 Podosek
5,931,828 A 8/1999 Durkee
5,934,289 A 8/1999 Watkins et al.
5,938,018 A 8/1999 Keaveney et al.
5,944,025 A 8/1999 Cook et al.
5,954,979 A 9/1999 Counts et al.
5,967,310 A 10/1999 Hill
5,975,415 A 11/1999 Zehnal
5,979,460 A 11/1999 Matsumura
5,996,589 A 12/1999 St. Charles
6,053,176 A 4/2000 Adams et al.
6,089,857 A 7/2000 Matsuura et al.
6,095,153 A 8/2000 Kessler et al.
6,102,036 A 8/2000 Slutsky et al.
6,125,853 A 10/2000 Susa et al.
6,155,268 A 12/2000 Takeuchi
6,164,287 A 12/2000 White
6,196,232 B1 3/2001 Chkadua
6,234,169 B1 5/2001 Bulbrook et al.
6,269,966 B1 8/2001 Pallo et al.
6,324,261 B1 11/2001 Merte
6,349,728 B1 2/2002 Pham
6,381,739 B1 4/2002 Breternitz, Jr. et al.
6,386,371 B1 5/2002 Parsons
6,431,363 B1 8/2002 Hacker
6,446,793 B1 9/2002 Layshock

(56) References Cited

U.S. PATENT DOCUMENTS 6,510,982 B2 1/2003 White et al.
6,532,965 B1 3/2003 Abhulimen et al.
6,536,442 B2 3/2003 St. Charles et al.
6,557,708 B2 5/2003 Polacco
6,598,607 B2 7/2003 Adiga et al.
6,603,924 B2 8/2003 Brown et al.
6,606,998 B1 8/2003 Gold
6,612,404 B2 9/2003 Sweet et al.
6,615,840 B1 9/2003 Fournier et al.
6,622,867 B2 9/2003 Menceles
6,655,379 B2 12/2003 Clark et al.
6,672,762 B1 1/2004 Faircloth et al.
6,688,313 B2 2/2004 Wrenn et al.
6,726,006 B1 4/2004 Funderburk et al.
6,772,756 B2 8/2004 Shayan
6,799,576 B2 10/2004 Farr
6,803,545 B2 10/2004 Blake et al.
6,805,545 B2 10/2004 Slaboden
6,810,883 B2 11/2004 Felter et al.
6,827,573 B2 12/2004 St. Charles et al.
6,954,979 B2 10/2005 Logan
7,000,775 B2 2/2006 Gelardi et al.
7,015,796 B2 3/2006 Snyder
7,488,171 B2 2/2009 St. Charles et al.
D590,990 S 4/2009 Hon
D590,991 S 4/2009 Hon
7,546,703 B2 6/2009 Johnske et al.
7,621,403 B2 11/2009 Althoff et al.
7,644,823 B2 1/2010 Gelardi et al.
7,726,320 B2 6/2010 Robinson et al.
7,767,698 B2 8/2010 Warchol et al.
D624,238 S 9/2010 Turner
7,801,573 B2 9/2010 Yazdi et al.
7,815,332 B1 10/2010 Smith
7,832,410 B2 11/2010 Hon
7,886,507 B2 2/2011 McGuinness, Jr.
D642,330 S 7/2011 Turner
D644,375 S 8/2011 Zhou
7,988,034 B2 8/2011 Pezzoli
D653,803 S 2/2012 Timmermans
8,141,701 B2 3/2012 Hodges
8,156,944 B2 4/2012 Hon
8,251,060 B2 8/2012 White et al.
8,322,350 B2 12/2012 Lipowicz
8,371,310 B2 2/2013 Brenneise
8,381,739 B2 2/2013 Gonda
8,387,612 B2 3/2013 Damani et al.
8,443,534 B2 5/2013 Goodfellow et al.
8,490,629 B1 7/2013 Shenassa et al.
8,511,318 B2 8/2013 Hon
8,539,959 B1 9/2013 Scatterday
8,541,401 B2 9/2013 Mishra et al.
D691,324 S 10/2013 Saliman
D695,450 S 12/2013 Benassayag et al.
8,596,460 B2 12/2013 Scatterday
8,671,952 B2 3/2014 Winterson et al.
D707,389 S 6/2014 Liu
8,741,348 B2 6/2014 Hansson et al.
8,809,261 B2 8/2014 Elsohly et al.
8,820,330 B2 9/2014 Bellinger et al.
8,851,081 B2 10/2014 Fernando et al.
8,869,792 B1 * 10/2014 Lee ..... A61M 15/0006 128/202.21
8,881,737 B2 11/2014 Collett et al.
8,915,254 B2 12/2014 Monsees et al.
8,925,555 B2 1/2015 Monsees et al.
D725,310 S 3/2015 Eksouzian
8,991,402 B2 3/2015 Bowen et al.
9,095,175 B2 8/2015 Terry et al.
9,215,895 B2 12/2015 Bowen et al.
9,220,302 B2 12/2015 DePiano et al.
9,226,526 B2 1/2016 Liu
9,271,525 B2 3/2016 Liu
9,271,529 B2 3/2016 Alima
9,272,103 B2 3/2016 Storz
9,277,769 B2 3/2016 Liu
9,282,772 B2 3/2016 Tucker et al.
9,282,773 B2 3/2016 Greim et al.
9,289,014 B2 3/2016 Tucker et al.
9,308,336 B2 4/2016 Newton
9,326,547 B2 5/2016 Tucker et al.
9,351,522 B2 5/2016 Safari
9,408,416 B2 8/2016 Monsees et al.
9,549,573 B2 1/2017 Monsees et al.
2001/0015209 A1 8/2001 Zielke
2001/0032643 A1 10/2001 Hochrainer et al.
2001/0032795 A1 10/2001 Weinstein et al.
2001/0052480 A1 12/2001 Kawaguchi et al.
2002/0078951 A1 6/2002 Nichols et al.
2002/0175164 A1 11/2002 Dees et al.
2003/0005926 A1 1/2003 Jones et al.
2003/0089377 A1 5/2003 Hajaligol et al.
2004/0031495 A1 2/2004 Steinberg
2004/0050382 A1 3/2004 Goodchild
2004/0055613 A1 * 3/2004 Horian ..... A24F 47/002 131/194
2004/0099266 A1 5/2004 Cross et al.
2004/0149296 A1 8/2004 Rostami et al.
2004/0149624 A1 8/2004 Wischusen et al.
2004/0173229 A1 9/2004 Crooks et al.
2004/0182403 A1 9/2004 Andersson et al.
2004/0221857 A1 11/2004 Dominguez
2004/0237974 A1 12/2004 Min
2005/0016549 A1 1/2005 Banerjee et al.
2005/0016550 A1 1/2005 Katase
2005/0034723 A1 2/2005 Bennett et al.
2005/0061759 A1 3/2005 Doucette
2005/0118545 A1 6/2005 Wong
2005/0145533 A1 7/2005 Seligson
2005/0172976 A1 8/2005 Newman et al.
2005/0244521 A1 11/2005 Strickland et al.
2005/0268911 A1 12/2005 Cross et al.
2006/0018840 A1 1/2006 Lechuga Ballesteros et al.
2006/0054676 A1 3/2006 Wischusen
2006/0102175 A1 5/2006 Nelson
2006/0150991 A1 7/2006 Lee
2006/0191546 A1 8/2006 Takano et al.
2006/0191548 A1 8/2006 Strickland et al.
2006/0254948 A1 11/2006 Herbert et al.
2006/0255105 A1 11/2006 Sweet
2007/0006889 A1 1/2007 Kobal et al.
2007/0045288 A1 3/2007 Nelson
2007/0062548 A1 3/2007 Horstmann et al.
2007/0074734 A1 4/2007 Braunshteyn et al.
2007/0098148 A1 5/2007 Sherman
2007/0102013 A1 5/2007 Adams et al.
2007/0144514 A1 6/2007 Yeates et al.
2007/0163610 A1 7/2007 Lindell et al.
2007/0215164 A1 9/2007 Mehio
2007/0235046 A1 10/2007 Gedevanishvili
2007/0267033 A1 11/2007 Mishra et al.
2007/0277816 A1 12/2007 Morrison et al.
2007/0280652 A1 12/2007 Williams
2007/0283972 A1 12/2007 Monsees et al.
2008/0023003 A1 1/2008 Rosenthal
2008/0029095 A1 2/2008 Esser
2008/0092912 A1 4/2008 Robinson et al.
2008/0149118 A1 6/2008 Oglesby et al.
2008/0216828 A1 9/2008 Wensley et al.
2008/0241255 A1 10/2008 Rose et al.
2008/0257367 A1 10/2008 Paterno et al.
2008/0276947 A1 11/2008 Martzel
2009/0004249 A1 1/2009 Gonda
2009/0095287 A1 4/2009 Emarlou
2009/0111287 A1 4/2009 Lindberg et al.
2009/0126745 A1 5/2009 Hon
2009/0133691 A1 5/2009 Yamada et al.
2009/0151717 A1 * 6/2009 Bowen ..... A61M 15/0028 128/200.23
2009/0230117 A1 9/2009 Fernando et al.
2009/0255534 A1 10/2009 Paterno
2009/0260642 A1 * 10/2009 Monsees ..... A24F 47/006 131/194
2009/0267252 A1 10/2009 Ikeyama

(56) References Cited

U.S. PATENT DOCUMENTS

2009/0272379 A1 11/2009 Thorens et al.
2009/0283103 A1 11/2009 Nielsen et al.
2009/0288668 A1 11/2009 Inagaki
2009/0288669 A1 11/2009 Hutchens
2009/0293892 A1 12/2009 Williams et al.
2009/0293895 A1 12/2009 Axelsson et al.
2010/0000672 A1 1/2010 Fogle
2010/0006092 A1 1/2010 Hale et al.
2010/0024834 A1* 2/2010 Oglesby ..... A24F 47/006 131/194
2010/0031968 A1 2/2010 Sheikh et al.
2010/0156193 A1 6/2010 Rhodes et al.
2010/0163063 A1 7/2010 Fernando et al.
2010/0186757 A1 7/2010 Crooks et al.
2010/0200008 A1 8/2010 Taieb
2010/0236562 A1 9/2010 Hearn et al.
2010/0242974 A1 9/2010 Pan
2010/0242976 A1 9/2010 Katayama et al.
2010/0275938 A1 11/2010 Roth et al.
2010/0276333 A1 11/2010 Couture
2010/0307116 A1 12/2010 Fisher
2011/0030706 A1 2/2011 Gibson et al.
2011/0036346 A1 2/2011 Cohen et al.
2011/0041861 A1 2/2011 Sebastian et al.
2011/0049226 A1 3/2011 Moreau et al.
2011/0094523 A1 4/2011 Thorens et al.
2011/0108023 A1 5/2011 McKinney et al.
2011/0155153 A1 6/2011 Thorens et al.
2011/0162667 A1 7/2011 Burke et al.
2011/0180433 A1 7/2011 Rennecamp
2011/0192397 A1 8/2011 Saskar et al.
2011/0226236 A1 9/2011 Buchberger
2011/0226266 A1 9/2011 Tao
2011/0232654 A1 9/2011 Mass
2011/0236002 A1 9/2011 Oglesby et al.
2011/0240047 A1 10/2011 Adamic
2011/0265806 A1 11/2011 Alarcon et al.
2011/0268809 A1 11/2011 Brinkley et al.
2011/0277780 A1 11/2011 Terry et al.
2011/0278189 A1 11/2011 Terry et al.
2011/0290267 A1* 12/2011 Yamada ..... A61M 15/06 131/329
2011/0315701 A1 12/2011 Everson
2012/0006342 A1 1/2012 Rose et al.
2012/0111347 A1 5/2012 Hon
2012/0199146 A1 8/2012 Marangos
2012/0204889 A1 8/2012 Xiu
2012/0227753 A1 9/2012 Newton
2012/0255567 A1 10/2012 Rose et al.
2012/0260927 A1 10/2012 Liu
2012/0267383 A1 10/2012 Van Rooyen
2012/0285475 A1 11/2012 Liu
2012/0325227 A1 12/2012 Robinson et al.
2013/0042865 A1* 2/2013 Monsees ..... G05D 23/1917 128/203.27
2013/0068239 A1 3/2013 Youn
2013/0140200 A1 6/2013 Scatterday
2013/0152922 A1 6/2013 Benassayag et al.
2013/0186416 A1 7/2013 Gao et al.
2013/0199528 A1 8/2013 Goodman et al.
2013/0228191 A1 9/2013 Newton
2013/0247924 A1 9/2013 Scatterday et al.
2013/0248385 A1 9/2013 Scatterday et al.
2013/0255702 A1 10/2013 Griffith, Jr. et al.
2013/0276802 A1 10/2013 Scatterday
2013/0298905 A1 11/2013 Levin et al.
2013/0312742 A1 11/2013 Monsees et al.
2013/0319440 A1 12/2013 Capuano
2013/0333700 A1 12/2013 Buchberger
2013/0340775 A1 12/2013 Juster et al.
2014/0000638 A1 1/2014 Sebastian et al.
2014/0007891 A1 1/2014 Liu
2014/0014126 A1 1/2014 Peleg et al.
2014/0041655 A1 2/2014 Barron et al.
2014/0053856 A1 2/2014 Liu
2014/0053858 A1 2/2014 Liu
2014/0060552 A1 3/2014 Cohen
2014/0060556 A1 3/2014 Liu
2014/0096782 A1 4/2014 Ampolini et al.
2014/0109921 A1 4/2014 Chen
2014/0116455 A1 5/2014 Youn
2014/0123990 A1 5/2014 Timmermans
2014/0144429 A1 5/2014 Wensley et al.
2014/0150810 A1 6/2014 Hon
2014/0174459 A1 6/2014 Burstyn
2014/0190501 A1 7/2014 Liu
2014/0190503 A1 7/2014 Li et al.
2014/0196731 A1 7/2014 Scatterday
2014/0196735 A1 7/2014 Liu
2014/0216450 A1 8/2014 Liu
2014/0230835 A1 8/2014 Saliman
2014/0261474 A1 9/2014 Gonda
2014/0270727 A1 9/2014 Ampolini et al.
2014/0301721 A1 10/2014 Ruscio et al.
2014/0305450 A1 10/2014 Xiang
2014/0345631 A1 11/2014 Bowen et al.
2014/0345635 A1 11/2014 Rabinowitz et al.
2014/0355969 A1 12/2014 Stern
2014/0366898 A1 12/2014 Monsees et al.
2014/0378790 A1 12/2014 Cohen
2015/0020823 A1 1/2015 Lipowicz et al.
2015/0020825 A1 1/2015 Galloway et al.
2015/0020831 A1 1/2015 Weigensberg et al.
2015/0027468 A1 1/2015 Li et al.
2015/0027472 A1 1/2015 Amir
2015/0034103 A1 2/2015 Hon
2015/0034104 A1 2/2015 Zhou
2015/0038567 A1 2/2015 Herkenroth et al.
2015/0040929 A1 2/2015 Hon
2015/0101625 A1 4/2015 Newton et al.
2015/0122252 A1 5/2015 Frija
2015/0122274 A1 5/2015 Cohen et al.
2015/0128965 A1 5/2015 Lord
2015/0128966 A1 5/2015 Lord
2015/0128967 A1 5/2015 Robinson et al.
2015/0128976 A1 5/2015 Verleur et al.
2015/0136153 A1 5/2015 Lord
2015/0136158 A1 5/2015 Stevens et al.
2015/0142387 A1 5/2015 Alarcon et al.
2015/0150308 A1 6/2015 Monsees et al.
2015/0157054 A1 6/2015 Liu
2015/0157056 A1 6/2015 Bowen et al.
2015/0164141 A1 6/2015 Newton
2015/0164144 A1 6/2015 Liu
2015/0164147 A1 6/2015 Verleur et al.
2015/0181928 A1 7/2015 Liu
2015/0189695 A1 7/2015 Xiang
2015/0196059 A1 7/2015 Liu
2015/0196060 A1 7/2015 Wensley et al.
2015/0208729 A1 7/2015 Monsees et al.
2015/0208731 A1 7/2015 Malamud et al.
2015/0216237 A1 8/2015 Wensley et al.
2015/0223521 A1 8/2015 Meriting et al.
2015/0224268 A1 8/2015 Henry et al.
2015/0237917 A1 8/2015 Lord
2015/0237918 A1 8/2015 Liu
2015/0245654 A1 9/2015 Memari et al.
2015/0245660 A1 9/2015 Lord
2015/0257445 A1 9/2015 Henry, Jr. et al.
2015/0258289 A1 9/2015 Henry, Jr. et al.
2015/0272220 A1 10/2015 Spinka et al.
2015/0282525 A1 10/2015 Plojoux et al.
2015/0282527 A1 10/2015 Henry, Jr.
2015/0305409 A1 10/2015 Verleur et al.
2015/0313275 A1 11/2015 Anderson et al.
2015/0313285 A1 11/2015 Waller et al.
2015/0320114 A1 11/2015 Wu
2015/0351456 A1 12/2015 Johnson et al.
2015/0366265 A1 12/2015 Lansing
2015/0366266 A1 12/2015 Chen
2016/0021931 A1 1/2016 Hawes et al.
2016/0021933 A1 1/2016 Thorens et al.
2016/0029698 A1 2/2016 Xiang
2016/0044967 A1 2/2016 Bowen et al.

(56) References Cited

U.S. PATENT DOCUMENTS

| | | | |
|---|---|---|---|
| 2016/0044968 | A1 | 2/2016 | Bowen et al. |
| 2016/0053988 | A1 | 2/2016 | Quintana |
| 2016/0057811 | A1 | 2/2016 | Alarcon et al. |
| 2016/0058071 | A1 | 3/2016 | Hearn |
| 2016/0058072 | A1 | 3/2016 | Liu |
| 2016/0073692 | A1 | 3/2016 | Alarcon et al. |
| 2016/0081393 | A1 | 3/2016 | Black |
| 2016/0081395 | A1 | 3/2016 | Thorens et al. |
| 2016/0095355 | A1 | 4/2016 | Hearn |
| 2016/0106154 | A1 | 4/2016 | Lord |
| 2016/0106155 | A1 | 4/2016 | Reevell |
| 2016/0106936 | A1 | 4/2016 | Kimmel |
| 2016/0109115 | A1 | 4/2016 | Lipowicz |
| 2016/0120218 | A1 | 5/2016 | Schennum et al. |
| 2016/0120227 | A1 | 5/2016 | Levitz et al. |
| 2016/0120228 | A1 | 5/2016 | Rostami et al. |
| 2016/0135503 | A1 | 5/2016 | Liu |
| 2016/0135506 | A1 | 5/2016 | Sanchez et al. |
| 2016/0143359 | A1 | 5/2016 | Xiang |
| 2016/0143360 | A1 | 5/2016 | Sanchez et al. |
| 2016/0143361 | A1 | 5/2016 | Juster et al. |
| 2016/0143365 | A1 | 5/2016 | Liu |
| 2016/0157524 | A1 | 6/2016 | Bowen et al. |
| 2016/0158782 | A1 | 6/2016 | Henry et al. |
| 2016/0192710 | A1 | 7/2016 | Liu |
| 2016/0206006 | A1 | 7/2016 | Li et al. |
| 2016/0227840 | A1 | 8/2016 | Xiang |
| 2016/0242466 | A1 | 8/2016 | Lord et al. |
| 2016/0249680 | A1 | 9/2016 | Liu |
| 2016/0262454 | A1 | 9/2016 | Sears et al. |
| 2016/0262459 | A1 | 9/2016 | Monsees et al. |
| 2016/0295924 | A1 | 10/2016 | Liu |
| 2016/0302471 | A1 | 10/2016 | Bowen et al. |
| 2016/0302483 | A1 | 10/2016 | Liu |
| 2016/0302486 | A1 | 10/2016 | Eroch |
| 2016/0309784 | A1 | 10/2016 | Silvestrini et al. |
| 2016/0324211 | A1 | 11/2016 | Yankelevich |
| 2016/0324215 | A1 | 11/2016 | Mironov et al. |
| 2016/0325858 | A1 | 11/2016 | Ampolini et al. |
| 2016/0331033 | A1 | 11/2016 | Hopps et al. |
| 2016/0331038 | A1 | 11/2016 | Farine et al. |
| 2016/0331040 | A1 | 11/2016 | Nakano et al. |
| 2016/0338410 | A1 | 11/2016 | Batista et al. |
| 2016/0338411 | A1 | 11/2016 | Liu |
| 2016/0338412 | A1 | 11/2016 | Monsees et al. |
| 2016/0345627 | A1 | 12/2016 | Liu |
| 2016/0345630 | A1 | 12/2016 | Mironov et al. |
| 2016/0345631 | A1 | 12/2016 | Monsees et al. |
| 2016/0360789 | A1 | 12/2016 | Hawes et al. |
| 2016/0366945 | A1 | 12/2016 | Rado |
| 2016/0366947 | A1 | 12/2016 | Monsees et al. |
| 2016/0368670 | A1 | 12/2016 | Beardsall |
| 2016/0371464 | A1 | 12/2016 | Bricker |
| 2016/0374390 | A1 | 12/2016 | Liu |
| 2016/0374398 | A1 | 12/2016 | Amir |
| 2016/0374399 | A1 | 12/2016 | Monsees et al. |
| 2016/0374400 | A1 | 12/2016 | Monsees et al. |

FOREIGN PATENT DOCUMENTS

| | | | |
|---|---|---|---|
| CN | 1122213 | A | 5/1996 |
| CN | 101869356 | A | 10/2010 |
| CN | 102754924 | A | 10/2012 |
| DE | 4200639 | A1 | 7/1992 |
| DE | 19854005 | A1 | 5/2000 |
| DE | 19854012 | A1 | 5/2000 |
| EP | 0532194 | A1 | 3/1993 |
| EP | 0535695 | A2 | 4/1993 |
| EP | 0283672 | B1 | 9/1993 |
| EP | 1458388 | A | 9/2004 |
| EP | 2325093 | B1 | 6/2012 |
| EP | 2609821 | A1 | 7/2013 |
| EP | 2152313 | B1 | 9/2014 |
| EP | 3024343 | A2 | 1/2015 |
| EP | 2856893 | A1 | 4/2015 |
| EP | 2908675 | A1 | 8/2015 |
| EP | 2319934 | B1 | 9/2015 |
| EP | 2915443 | A1 | 9/2015 |
| EP | 3056099 | A1 | 8/2016 |
| EP | 3062646 | A1 | 9/2016 |
| EP | 3065581 | A2 | 9/2016 |
| EP | 3068244 | A1 | 9/2016 |
| EP | 3075271 | A1 | 10/2016 |
| EP | 3081102 | A1 | 10/2016 |
| ES | 2118034 | A1 | 9/1998 |
| GB | 1025630 | A | 4/1966 |
| GB | 1065678 | A | 4/1967 |
| IE | S2005-0051 | | 2/2005 |
| IE | S2005-0563 | | 8/2005 |
| IE | S2005-0615 | | 9/2005 |
| JP | 62-278975 | | 12/1987 |
| JP | 64-37276 | A | 2/1989 |
| JP | 02-145179 | A | 6/1990 |
| JP | 03-049671 | | 3/1991 |
| JP | 03-180166 | | 8/1991 |
| JP | 09-075058 | | 3/1997 |
| JP | 10-501999 | A | 2/1998 |
| JP | 11-178563 | | 7/1999 |
| JP | 2000-203639 | | 7/2000 |
| JP | 2000-236865 | A | 9/2000 |
| JP | 2001-165437 | A | 6/2001 |
| JP | 2005-034021 | A | 2/2005 |
| JP | 2006-504430 | A | 2/2006 |
| KR | 0193885 | B1 | 6/1999 |
| WO | WO95/01137 | A1 | 1/1995 |
| WO | WO97/12639 | A1 | 4/1997 |
| WO | WO00/28842 | A1 | 5/2000 |
| WO | WO03/056948 | A1 | 7/2003 |
| WO | WO03/082031 | A1 | 10/2003 |
| WO | WO03/094900 | A1 | 11/2003 |
| WO | WO 03/103387 | A2 | 12/2003 |
| WO | WO2004/064548 | A1 | 8/2004 |
| WO | WO2004/080216 | A1 | 9/2004 |
| WO | WO2005/020726 | A1 | 3/2005 |
| WO | WO2006/015070 | A1 | 2/2006 |
| WO | WO-2006/120570 | A2 | 11/2006 |
| WO | WO2007/026131 | A1 | 3/2007 |
| WO | WO2007/078273 | A1 | 7/2007 |
| WO | WO2008/077271 | A1 | 7/2008 |
| WO | WO2010/023561 | A1 | 3/2010 |
| WO | WO2011/033396 | A2 | 3/2011 |
| WO | WO2011/117580 | A2 | 9/2011 |
| WO | WO2012/021972 | A1 | 2/2012 |
| WO | WO2012/027350 | A2 | 3/2012 |
| WO | WO2012/085207 | A1 | 6/2012 |
| WO | WO2012/120487 | A2 | 9/2012 |
| WO | WO2013/044537 | A1 | 4/2013 |
| WO | WO2013/050934 | A1 | 4/2013 |
| WO | WO2013/083635 | A1 | 6/2013 |
| WO | WO2013/089551 | A1 | 6/2013 |
| WO | WO2013/098398 | A2 | 7/2013 |
| WO | WO2013/142678 | A1 | 9/2013 |
| WO | WO2014/040915 | A1 | 3/2014 |
| WO | WO2014/093127 | A2 | 6/2014 |
| WO | WO2014/101734 | A1 | 7/2014 |
| WO | WO2014/118286 | A2 | 8/2014 |
| WO | WO2014/139611 | A1 | 9/2014 |
| WO | WO2014/140087 | A1 | 9/2014 |
| WO | WO2014/150704 | A2 | 9/2014 |
| WO | WO2014/159982 | A1 | 10/2014 |
| WO | WO2014/187763 | A1 | 11/2014 |
| WO | WO2014/187770 | A2 | 11/2014 |
| WO | WO2014/205263 | A1 | 12/2014 |
| WO | WO2015/006652 | A1 | 1/2015 |
| WO | WO2015/009862 | A2 | 1/2015 |
| WO | WO2015/028815 | A1 | 3/2015 |
| WO | WO2015/040180 | A2 | 3/2015 |
| WO | WO2015/058387 | A1 | 4/2015 |
| WO | WO2015/063126 | A1 | 5/2015 |
| WO | WO2015/082652 | A1 | 6/2015 |
| WO | WO2015/089711 | A1 | 6/2015 |
| WO | WO2015/101651 | A1 | 7/2015 |
| WO | WO2015/109616 | A1 | 7/2015 |
| WO | WO2015/124878 | A1 | 8/2015 |

(56) References Cited

FOREIGN PATENT DOCUMENTS

| | | | |
|---|---|---|---|
| WO | WO2015/148547 | A1 | 10/2015 |
| WO | WO2015/149647 | A1 | 10/2015 |
| WO | WO2015/168828 | A1 | 11/2015 |
| WO | WO2015/169127 | A1 | 11/2015 |
| WO | WO2015/179641 | A1 | 11/2015 |
| WO | WO2015/193456 | A1 | 12/2015 |
| WO | WO2016/012769 | A1 | 1/2016 |
| WO | WO2016/014652 | A1 | 1/2016 |
| WO | WO2016/020675 | A1 | 2/2016 |
| WO | WO2016/030661 | A1 | 3/2016 |
| WO | WO2016/040575 | A1 | 3/2016 |
| WO | WO2016/041114 | A1 | 3/2016 |
| WO | WO2016/041140 | A1 | 3/2016 |
| WO | WO2016/050247 | A1 | 4/2016 |
| WO | WO2016/054580 | A1 | 4/2016 |
| WO | WO2016/058189 | A1 | 4/2016 |
| WO | WO2016/062777 | A1 | 4/2016 |
| WO | WO2016/063775 | A1 | 4/2016 |
| WO | WO2016/065606 | A1 | 5/2016 |
| WO | WO2016/071705 | A1 | 5/2016 |
| WO | WO2016/071706 | A1 | 5/2016 |
| WO | WO2016/074230 | A1 | 5/2016 |
| WO | WO2016/076178 | A1 | 5/2016 |
| WO | WO2016/079152 | A1 | 5/2016 |
| WO | WO2016/079155 | A1 | 5/2016 |
| WO | WO2016/082183 | A1 | 6/2016 |
| WO | WO2016/084018 | A1 | 6/2016 |
| WO | WO2016/127396 | A1 | 8/2016 |
| WO | WO2016/156103 | A1 | 10/2016 |
| WO | WO2016/165125 | A1 | 10/2016 |

OTHER PUBLICATIONS

Bombick et al.; Chemical and biological studies of a new cigarette that primarily heats tobacco; Part 3: In vitro toxicity of whole smoke; Food and Chemical Toxicology; 36(3); pp. 191-197; Mar. 1998.

Bombick et al.; Chemical and biological studies of a new cigarette that primarily heats tobacco; Part 2: In vitro toxicology of mainstream smoke condesnsate; Food and Chemical Toxicology; 36(3); pp. 183-190; Mar. 1998.

Borgerding et al.; Chemcal and biological studies of a new cigarette that primarily heats tobacco; Part 1: Chemical composition of mainstream smoke; Food and Chemical Toxicology; 36(3); pp. 169-182; Mar. 1998.

Bradley et al.; Electronic cigarette aerosol particle size distribution measurements; Inhal. Toxicol.; 24(14); pp. 976-984; Dec. 2012.

Bullen et al.; Effect of an electronic nicotine delivery device (e cigarette) on desire to smoke and withdrawal, user preferences and nicotine delivery: randomised cross-over trial; Tobacco Control; 19(2); pp. 98-103; Apr. 2010.

Burch et al.; Effect of pH on nicotine absorption and side effects produced by aerosolized nicotine; Journal of Aerosol Medicine: Deposition, Clearance, and Effects in the Lung; 6(1); pp. 45-52; 1993.

Capponnetto et al.; Successful smoking cessation with cigarettes in smokers with a documented history of recurring relapses: a case series; Journal of Medical Case Reports; 5(1); 6 pages; (year of pub. sufficiently earlier than effective US filing date and any foreign priority date); 2011.

ECF; Any interest in determining nicotine—by DVAP; (https://www.e-cigarette-forum.com/forum/threads/any-interest-in-determining-nicotine-by-dvap.35922/); blog posts dated: 2009; 8 pgs.; print/retrieval date: Jul. 31, 2014.

E-Cigarette Forum; pg-vg-peg (discussion/posting); retrieved from the internet: https://e-cigarette-forum.com/forum/threads/pg-vg-peg. 177551; 7 pgs.; Apr. 8, 2011.

Farsalinos et al.; Electronic cigarettes do not damage the heart; European Society of Cardiology; 4 pages; retrieved from the internet (http://www.escardio.org/The-ESC/Press-Office/Press-releases/Electronic-cigarettes-do-not-damage-the-heart); Aug. 25, 2012.

Flouris et al.; Acute impact of active and passive electronic cigarette smoking on serum cotinine and lung function; Inhal. Toxicol.; 25(2); pp. 91-101; Feb. 2013.

Food & Drug Administration; Warning letter to The Compounding Pharmacy; retrieved Oct. 10, 2014 from http://www.fda.gov/ICECI/EnfocementActions/WarningLetters/2002/ucm144843.htm; 3 pgs.; Apr. 9, 2002.

Goniewicz et al.; Nicotine levels in electronic cigarettes; Nicotine Tobacco Research; 15(1); pp. 158-166; Jan. 2013.

Harvest Vapor; American Blend Tobacco (product info.); retrieved from the internet (http://harvestvapor.com/); 2 pgs.; print/retrieval date: Oct. 10, 2014.

Hurt et al.; Treating tobacco dependence in a medical setting; Ca: A Cancer Journal for Clinicians; 59(5); pp. 314-326; Sep. 2009.

INCHEM; Benzoic Acid; JECFA Evaluation Summary; retrieved Oct. 10, 2014 from http://www.inchem.org/documents/jecfa/feceval/jec_184.htm; 2 pgs..; May 28, 2005.

INCHEM; Levulinic Acid; JECFA Evaluation Summary; retrieved Oct. 10, 2014 from http://www.inchem.org/documents/jecfa/feceval/jec_1266.htm; 1 pg.; Mar. 10, 2003.

INCHEM; Pyruvic Acid; JECFA Evaluation Summary; retrieved Oct. 10, 2014 from http://www.inchem.org/documents/jecfa/feceval/jec_2072.htm; 1 pg.; Jan. 29, 2003.

INCHEM; Sorbic Acid; JECFA Evaluation Summary; retrieved Oct. 10, 2014 from http://www.inchem.org/documents/jecfa/feceval/jec_2181.htm; 1 pg.; May 29, 2005.

Ingebrethsen et al.; Electronic cigarette aerosol particle size distribution measurements; Inhalation Toxicology; 24(14); pp. 976-984; Dec. 2012.

Kuo et al.; Appendix D: Particle size-U.S. sieve size and tyler screen mesh equivalents; Applications of Turbulent and Multiphase Combustion; John Wiley & Sons, Inc.; pp. 541-543; May 1, 2012.

McCann et al.; Detection of carcinogens as mutagens in the salmonella/microsome test: Assay of 300 chemicals: Discussion; Proc. Nat. Acad. Sci.; 73(3); pp. 950-954; Mar. 1976.

Mirriam-Webster Online Dictionary; Lighter; retrieved Jan. 4, 2013 from the internet: (http://www.merriam-webster.com/dictionary/lighter?show=0&t=1357320593); 2 pgs.; print date: Jan. 4, 2013.

Nicoli et al.; Mammalian tumor xenografts induce neovascularization in Zebrafish embryos; Cancer Research; 67(7); pp. 2927-2931; Apr. 1, 2007.

Perfetti; Structural study of nicotine salts; Beitrage zur Tabakforschung International; Contributions to Tobacco Research; 12(2); pp. 43-54; Jun. 1983.

Seeman et al.; The form of nicotine in tobacco. Thermal transfer of nicotine and nicotine acid salts to nicotine in the gas phase; J Aric Food Chem.; 47(12); pp. 5133-5145; Dec. 1999.

Torikai et al.; Effects of temperature, atmosphere and pH on the generation of smoke compounds duriung tobacco pyrolysis; Food and Chemical Toxicology; 42(9); pp. 1409-1417; Sep. 2004.

Vansickel et al.; A clinical laboratory model for evaluating the acute effects of electronic cigarettes: Nicotine delivery profile and cardiovascular and subjective effects; Cancer Epidemiology Biomarkers Prevention; 19(8); pp. 1945-1953; (online) Jul. 20, 2010.

Vansickel et al.; Electronic cigarettes: effective nicotine delivery after acute administration; Nicotine & Tobacco Research; 15(1); pp. 267-270; Jan. 2013.

Ward; Green leaf threshing and redrying tobacco; Section 10B; in TOBACCO Production, Chemistry and Technology; Davis and Nielsen (Eds.); Blackwell Science Ltd.; pp. 330-333; Jul. 15, 1999.

Wells; Glycerin as a constituent of cosmetics and toilet preparations; Journal of the Society of Cosmetic Chemists; 9(1); pp. 19-25; Jan. 1958.

YouTube; Firefly Vaporizor Review w/ Usage Tips by The Vape Critic; retrieved from the internet (http://www.youtube.com/watch?v=1J38N0AV7wl); 1 pg.; published Dec. 10, 2013; download/print date: Feb. 18, 2015.

Zhang et al.; In vitro particle size distributions in electronic and conventional cigarette aerosols suggest comparable deposition patterns; Nicotine Tobacco Research; 15(2); pp. 501-508; Feb. 2013.

(56) References Cited

OTHER PUBLICATIONS

Monsees, J.; U.S. Appl. No. 12/115,400 entitled "Method And System For Vaporization Of A Substance", filed May 5, 2008.
Monsees et al.; U.S. Appl. No. 15/257,748 entitled "Cartridge for use with a vaporizer device," filed Sep. 6, 2016.
Monsees et al.; U.S. Appl. No. 15/368,539 entitled "Low temperature electronic vaporization device and methods," filed Dec. 2, 2016.
Monsees et al.; U.S. Appl. No. 15/379,898 entitled "Vaporization device systems and methods," filed Dec. 15, 2016.

* cited by examiner

SYSTEMS AND METHODS FOR AEROSOLIZING A VAPORIZABLE MATERIAL

CROSS-REFERENCE

This application is a national phase application, filed under 35 U.S.C. § 371, of PCT International Patent Application No. PCT/US2015/031152, filed May 15, 2015, which claims the benefit of U.S. Provisional Patent Application Ser. No. 61/994,787 filed May 16, 2014, the disclosures of all of which are incorporated herein by reference in their entirety.

BACKGROUND

Smoking devices, such as cigarette holders and pipes are well known in the art for providing flavored vapor from a smokeable substance to a user for therapeutic and smoking pleasure. However, existing devices used have no control of heating and combustion of the tobacco products. The devices tend to produce toxic, tarry and carcinogenic by-products which are harmful and also impart a bitter and burnt taste to a mouth of a user.

A further problem is that there is no control of contamination of the inhaled vapor mixture with heater exhaust gases, due to inappropriate proportioning and location of the inlets and the exhaust vents. Typically, the exhaust gas is used to directly heat the tobacco, and those gases contain harmful byproducts of incomplete combustion.

In an effort to overcome these deficiencies, there is a need for providing a device structure and substance for producing vapor for smoking which is free from harmful by-product and provides a cool and soothing vapor for smoking.

SUMMARY

The present invention is directed to improvements in smoking devices, particularly to smoking articles which employ a formed smokeable material cartridge as a source of producing vapor by heat transfer to the cartridge by conduction, convection and/or radiation for smoke and flavor. The present invention relates to self-contained vaporization devices, and more particularly, to a low-temperature vaporization device for use with tobacco, botanicals or other smokeable products. The device is of an elongated main body with a mouthpiece at one end and an attached tubular casing at the other end having a vaporization chamber and a heater. The mouthpiece and the casing form a unitary unit. The device can be portable.

The present invention is drawn to a novel smoking device consisting of a mouthpiece and a casing having a heater, a low temperature vaporization chamber, a fuel tank, an igniter with control means for maintaining equilibrium point by keeping the operating temperature below about 400 F. In some examples, the operating temperature is below 350 about F. In order to maintain a stable operating temperature, a thermal regulator can be used to control flow rate of the fuel.

Further provided herein is a mouthpiece made of a high temperature food-safe material, such as ceramic, glass, or high temperature plastics known as PEI resin (brand name Ultem). However, suitable plastic or wood, etc., can also be used but may additionally require an insulating material to prevent excessive heat reaching the user's lips.

Additionally, air inlets are directed downwards, so that fresh ambient air drawn through mixes with the vapor generated into the vaporization chamber located above the smokeable substance cartridge, which is extracted from the cartridge by inlets located below the cartridge and drawn into user's mouth for inhalation.

It is another object of the invention to provide air inlet or inlets having a diameter and direction sized to admit ambient air into the chamber to heat up the substance and not effect the operating temperature and also regulating the velocity of ambient air entering and mixing with the vapor generated heating in the chamber at such a rate that the proportionate inhalation passage provides a perception to the user as if the smoke is drawn through a cigarette.

It is still another object of the invention to provide a heater which is separated from the vapor chamber by an insulating medium such as ring made of PTFE, ceramic or other insulating material and thereby preventing the exhaust gases produced by the heater from entering and contaminating the vapor in the vaporization chamber collected for inhalation.

Another object of the invention provides a heater formed of a conductive shell and a catalyst. The shell may be of one or more material formed by welding or pressing together. The catalyst can be of platinum or palladium impregnated metal or glass or other suitable material, which provides for efficient flameless combustion of the fuel and glows red when heated to indicate that the device is activated. Additionally, a feedback loop can be employed to regulate the desired temperature.

In some implementations, the smokeable material cartridge may be formed and shaped for easier insertion into the heating chamber and to snugly fit into the cavity of the heating chamber for improved thermal conduction and vaporization. The cartridges may be formed and wrapped into a wrapper. In some implementations, the smokeable material may be provided in a loose form in a pouch. The wrappers and pouches may be formed of a material which does not produce significant amount of harmful gases.

An aspect of the present disclosure relates to a cartridge fitted in a device, the cartridge comprising a permeable pouch containing a smokeable material, wherein the device is configured to heat the smokeable material in the permeable pouch, and wherein the permeable pouch allows an exit of a vapor generated from the heating of the smokeable material.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings or figures (also "FIG." and "FIGS." herein), of which:

DETAILED DESCRIPTION

Figure 1:
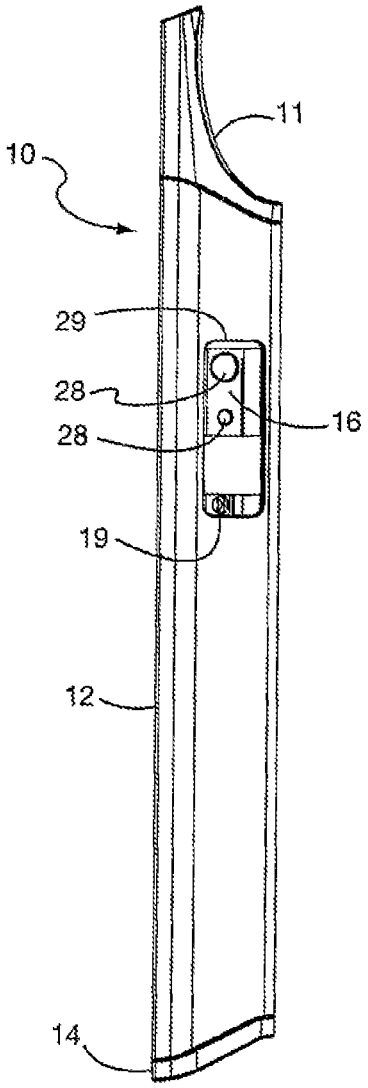
FIG. 1 is a side view of a vaporization device.
Figure 2:
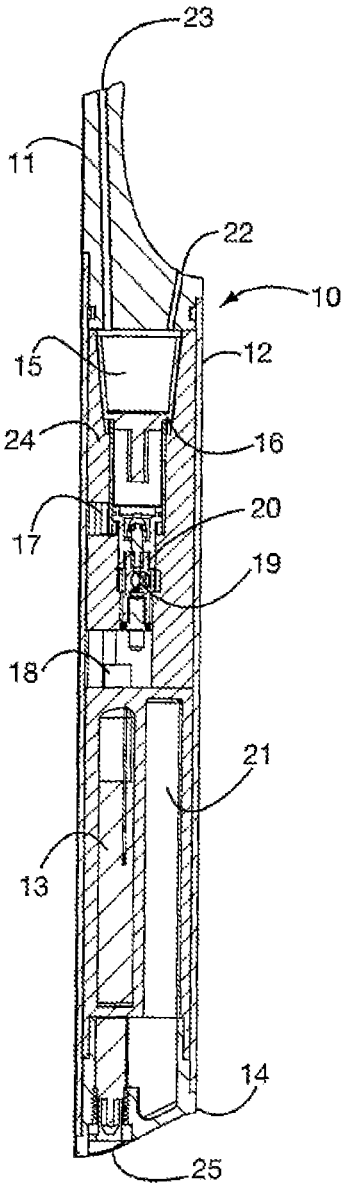
FIG. 2 is a sectional view of the vaporization device in FIG. 1.

Referring to FIG. 1 and FIG. 2, the exterior of the device 10 comprises a mouthpiece 11, a tubular case 12, and the base 14 of a butane tank 21. The mouthpiece is removable and creates an airtight seal with the interior of the case. With the mouthpiece removed, a cartridge (FIG. 5) is introduced to vaporization chamber 15 of a heater 16. The mouthpiece is then reinserted to close the device.

The mouthpiece is made of a high-temperature and food-safe material such as ceramic, glass, or various high-temperature plastics such as PEI resin (brand name Ultem). Design is simplified by use of high temperature materials, but standard plastics or wood, etc, can also be used with the addition of an insulating component that prevents any excessive heat from reaching the user's lips.

To activate the device, the butane tank is pulled axially outward, partially removing it from the case. This starts the flow of butane by opening a master valve 18, and then activating a piezoelectric igniter 13. The tank remains in the partially removed position for the duration of use. While the master valve is open, butane flows through a thermal regulator 17, and into the carburetor 20. Ambient air enters the case through slot 19. A venturi in the carburetor entrains air, causing it to mix with the butane. The mixture then flows into the heater 16.

The lead of the ignitor is positioned in the heater. With the spark of the ignitor (immediately following the start of gas flow) the gas ignites and heat starts conducting throughout the heater. Heat transfers to the cartridge by conduction, convection and/or radiation. The cartridge is shaped to fill the chamber, so as to maximize surface contact for thermal conduction.

As the cartridge heats, vapor generates within the cartridge and in the space immediately above it. When a user draws on the device, fresh air enters through air inlet 22, mixes with the vapor, and the mixture is delivered to the user via the inhalation passage 23. The air inlet or inlets can be directed downward, so as to improve the extraction of vapor from the cartridge. They can also be directed along a diagonal through the mouthpiece, or laterally through the case itself, above the cartridge.

Figure 3:
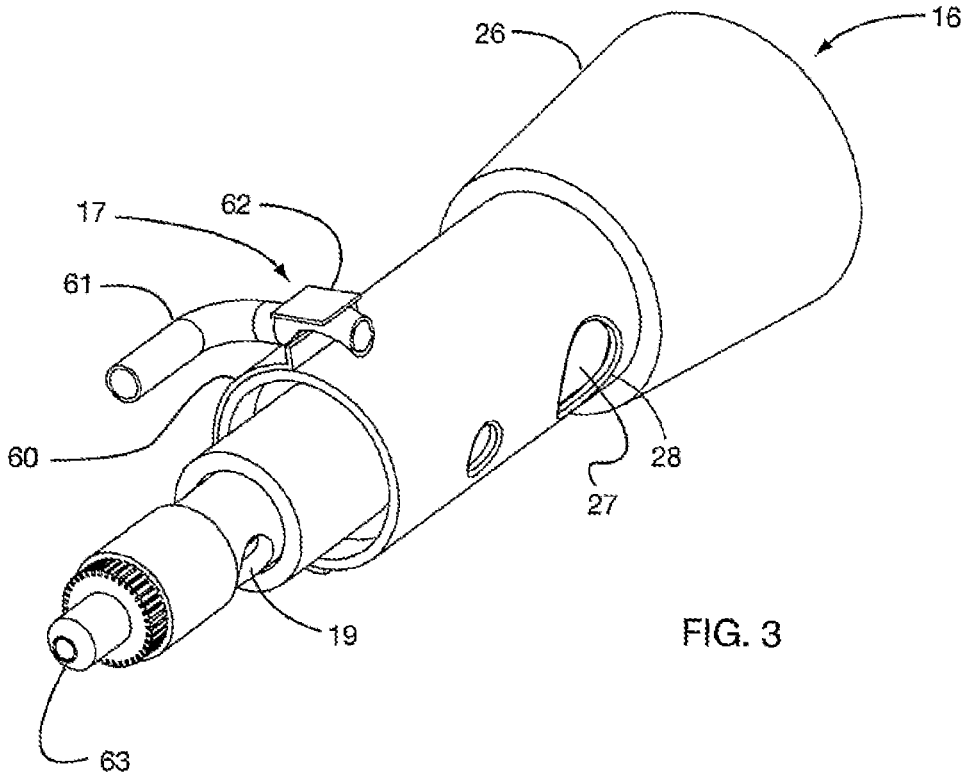
FIG. 3 is a perspective view of a heater.

FIG. 3 depicts a detailed view of the heater 16. The heater comprises a thermally conductive shell 26 and catalyst 27. The shell can be comprised of one material, or a combination of materials welded or pressed together. The catalyst can be platinum- or palladium-impregnated metal or glass, or other suitable material known to those skilled in the art. The catalyst provides for efficient flame-less combustion of the butane. The vent 28 of the heater is positioned such that it is visible through the slot 29 of the body as shown in FIG. 1. This allows the user to see the catalyst which, when heated, can glow red to indicate that the device has been activated.

Referring again to FIG. 3, adjacent to the heater and in intimate thermal contact is the thermal regulator 17. As the temperature of the heater increases, so does that of the regulator. The regulator is designed to restrict the flow of butane as the temperature increases, thus creating a feedback loop. The regulator can consist of a bimetallic strip 60 and silicone tubing 61 which is the conduit of the butane. The two are arranged such that as the bimetallic strip heats up, it curls to pinch the silicone tube and thereby restrict the flow of butane. The reduced flow of butane results in less heat generated. The heater subsequently cools down, and so does the regulator, allowing more butane to flow again. The overall result is that a stable operating temperature is established in the heater. Such a system can be readily tuned to achieve an operating temperature that varies by less than +1-5 degrees Fahrenheit.

The regulator further comprises a moveable backplate 62 which allows adjustability of the operating temperature by adjusting the temperature at which the bimetallic actuator closes the tube valve. This is to be performed once at manufacture, to calibrate the device. Alternatively, a control means may be used to allow the target temperature of the device changed during operation.

The regulator can comprise in part a bimetallic strip and silicone tubing valve. Alternatively, the regulator can be comprised of other materials and configurations, as described later.

The desired operating temperature for vaporizing the smokeable materials herein can be below about 400 F. In some cases, the operating range can be below about 350 F. For example, for the purposes of vaporizing most botanicals in this device, the desired operating temperature is below about 400 F, or, in some cases, below about 350 F.

The air inlet diameter can be sized such that inhalation is somewhat inhibited. This allows time for ambient air entering the chamber to heat up and not affect operating temperature considerably. It also increases velocity of the entering air, which improves circulation and mixing in the vaporization chamber. It also creates a partial vacuum, lowering the vapor point temperature for material contained in the vaporization chamber. The reduction in draw rate can also serve to give the impression of drawing on a cigarette or pipe. Both the fresh air inlet and inhalation passage can be adjusted to provide appropriate draw rate for the operating temperature of the device, and the perception intended for the user.

Once the cartridge is consumed, the device is turned off by pushing the tank back into the case, closing the master valve. The spent cartridge is removed by opening the device and turning the body over. The cartridge can simply fall out. Alternatively, a mechanism can be used to quickly and easily remove the cartridge. This mechanism can include, but does not require, the use of a pin or slide part to eject the cartridge as another part of the device is moved or removed. The removal mechanism can also involve introduction of a foreign object.

In some implementations, the mouthpiece may be permanently attached to the body. In that case, the vaporization chamber may be accessed by operating a sliding or hinged door, or similar means, built into the device.

The heater of the device is fitted into the case with an inslator 24. The insulator can be made of PEI (brand name Ultem), ceramic, or other insulating material. The insulator serves to minimize thermal transfer from the heater to the case, while creating an air-tight seal. The seal prevents exhaust gases produced by the heater from entering the vaporization chamber. Exhaust gases are instead vented out the case slots. Since the air inlet is distant from the slots, there is substantially no contamination of the inhaled vapor mixture by heater exhaust gases.

In some implementations, the insulator can be a partially hollow shell, containing a sealed vacuum. In yet other implementations, the heater may be sealed directly to the case by braising in a vacuum furnace, so as to create a vacuum between the two and obviate need for an insulator component.

The tank can be made of a translucent material. This allows the user to determine the level of fuel remaining by looking at the base of the tank.

The case can be made of a material that is either a good thermal conductor (such as aluminum), or a poor one (such as ceramics). In both cases, the effect is that the body remains cool enough to touch over a large portion of its surface.

In one example, a bimetallic actuator can be used in the regulator. In another example, a shape memory alloy actuator such nickel-titanium alloys ("Nitinol") can be used. In yet another example, a paraffin-filled component that expands and contracts to modulate butane flow can be employed. In a further example, a system can be employed to measure the current temperature, e.g., with a thermocouple sensor and compare it to a prescribed temperature, e.g., with a micro-controller, and by controlling an electromechanical valve, e.g., servo or solenoid valve. In a configuration with user-selected temperature, as described above, the selected temperature can be used as an input to this system.

A thermal regulator may be used. Alternatively, the device may be constructed without an active regulating element. This may result in reduced complexity and in lowering the overall cost of the device. In this case, the flow of butane is set at a low level. In use, the temperature inside the chamber increases until an equilibrium point where additional heat introduced equals the heat lost to the environment. Heat is lost by conduction through the body of the device, and with the vapor delivered to the user. This equilibrium point determines the operating temperature of the device. By changing the butane flow rate, size and material of the burner, and other factors, the system can be calibrated to provide a fairly stable desired operating temperature.

An advantage of the bimetallic regulator feedback loop methods over the equilibrium method is that the operating temperature is not dependent on environmental factors such as ambient temperature and wind.

A piezo-electric ignitor can be used. Other ignitors may be used, such as, a flint starter or battery-powered resistive coil.

The butane tank may be refillable, and may have a port 25 for that purpose. Alternatively, the tank may be disposable once its fuel is exhausted. A release mechanism such as a pin or cam may be employed allowing the user to quickly remove the depleted tank and replace it with a full one. The replaceable tank may include additional parts of the device including, but not limited to, the ignitor and heater. Butane can be used as the fuel source, but may be replaced by other liquid fuels, such as ethanol.

Various means of feedback may be used to indicate the following states or metrics of the device: 1) the device is on, 2) the current temperature of the vaporization chamber, 3) the chamber is below a prescribed operating temperature, 4) the chamber has reached a prescribed operating temperature and vapor is ready for consumption, and 5) the chamber has exceeded a prescribed operating temperature.

The means of the feedback includes both physical and electronic implementations. Possibilities include thermochromatic paint, light-emitting diodes and liquid crystal display. The sensing and control means for electronic feedback can be implemented by use of thermocouple and micro-controller, as is known to those skilled in the art.

The smokeable materials herein may include, but are not limited to, tobacco, botanicals (e.g., *cannabis*, chamomile), pharmaceuticals, nutraceuticals, natural or artificial flavorants, coffee grounds or coffee beans, mint, lemon, honey, tea leaves, cocoa, or any other substance providing a benefit or sensation to an end user.

The smokeable materials herein may be provided in loose leaf form, cut form, shredded form, chopped form, packed form, or any other natural or processed form. As described elsewhere herein, in some examples, the smokeable material may comprise fine pieces of tobacco. In other examples, the smokeable material may comprise loose leaf tobacco. In yet other examples, the smokeable material may comprise loose leaf, shredded or chopped botanicals (e.g., loose leaves, shredded. The smokeable material comprise a vapor forming medium (e.g., glycerin).

Active elements contained in botanicals may vaporize at different temperatures. The device may be calibrated to establish a single stable temperature, intended for vaporizing solely tobacco or solely chamomile, for example. A control means may be used to select a variety of temperature settings. The user may choose which setting based on the type of cartridge used. The control means can effect a desired temperature mechanically, such as by changing flow rate of the valve, or electronically, such as by electromechanical valve and micro-controller intermediary.

In some examples, butane may provide the most energy-dense and practical fuel source. In some examples, the butane heating system is replaced by a battery-powered electric heater or other compact heat source.

Figure 4:
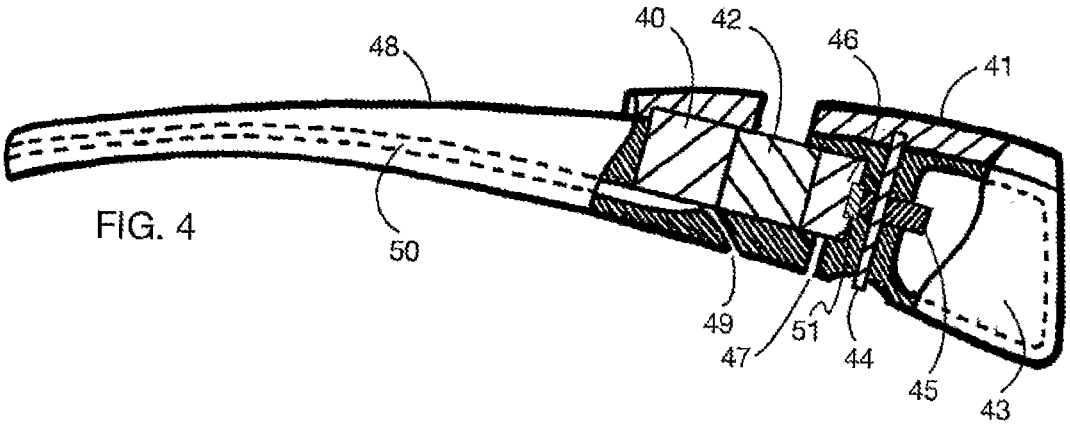
FIG. 4 is a cutaway view of an alternate vaporization device.

FIG. 4 depicts a cutaway view of a vaporization device which more closely resembles a traditional pipe form. In this configuration, the device retains all of the critical elements from the configuration in FIG. 1. The user inserts a cartridge 40, under a sliding top piece 41, where the cartridge mates with the heater 42. Fuel held in the tank 43 is released by turning dial 44 to open master valve 45. The fuel travels through the regulator 51, and then through the carburetor 46 where it draws in air through the intake port 47 and catalyzes in a manner similar to that of the configuration in FIG. 1. As the cartridge 40 reaches its operating temperature the user places the mouthpiece 48 in their mouth and draws air in through the inhalation intake port 49 and through the vapor passage 50 where it is pre-cooled.

A cartridge comprising the smokeable material may be fitted in the device 10. The device can be configured to heat the smokeable material in the cartridge. The device can heat the smokeable material (e.g., in the vaporization chamber) to a temperature required to vaporize the smokeable material. The cartridge can be inserted into the heated vaporization chamber of the device. For example, the device can heat the cartridge to below about 400 F. The cartridge may comprise a wrapper, a permeable pouch or a perforated container.

In some examples, the smokeable material (e.g., a moist smokeable material that may need to be contained in a wrapper) may be provided in a wrapper. The wrapper may be provided with a perforation that allows an exit of a vapor generated from heating the smokeable material. The perforation may further comprise an aeration well that allows air to access the smokeable material.

In some examples, the smokeable material (e.g., dry and/or loose smokeable material that may not need to be contained in a wrapper) may be provided in a permeable pouch. The pouch may be permeable to gases (e.g., air, vapor generated from heating the smokeable material, etc.). The permeable pouch may allow air to access the smokeable material. The permeable pouch may allow an exit of a vapor generated from heating the smokeable material. The permeable pouch may eliminate the need to directly expose the smokeable material to the surroundings (e.g., by leaving a portion of the smokeable material exposed, as shown, for example, in FIG. 7, or by providing perforations, in some cases together with aeration wells, that allow vapor to exit and/or air to enter, as shown, for example, in FIGS. 5, 6 and 8). The permeable pouch may eliminate the need to puncture the cartridge. The permeable pouch may be permeable on all surfaces. All surfaces of the permeable pouch may be permeable. The permeable pouch may comprise one or more permeable surfaces. Further, the permeable pouch may enhance air and vapor transport to and from the smokeable material (e.g., by providing air and vapor transfer across a larger surface of the pouch as compared to the vapor transfer available in a cartridge that only has a single or more than one perforations on one or two sides).

In some examples, the smokeable material (e.g., dry and/or loose smokeable material that may not need to be contained in a wrapper) may be provided in a perforated container. The perforated container may comprise or be formed of a metallic foil (e.g. aluminum, stainless steel, or copper) with a perforation pattern to allow gas transfer through the container. The perforated container may have a perforation pattern on at least one surface of the container. The perforated container may allow air to access the smokeable material. The perforated container may allow an exit of a vapor generated from heating the smokeable material. The perforated container may eliminate the need to directly expose the smokeable material to the surroundings. The perforated container may eliminate the need to puncture the cartridge. Further, the perforated container may enhance air and vapor transport to and from the smokeable material (e.g., by providing air and vapor transfer across a larger surface). The perforated container may comprise or be formed of a thermally conductive material to enhance heat transfer to the smokeable material. The perforated container may be perforated on all surfaces. All surfaces of the perforated container may comprise perforations. The perforated container may comprise one or more perforated surfaces. Further, the perforated container may enhance air and vapor transport to and from the smokeable material (e.g., by providing air and vapor transfer across a larger surface of the container as compared to the vapor transfer available in a cartridge that only has a single or more than one perforations on one side or only on two opposing sides).

Any aspects of the disclosure described in relation a cartridge comprising a wrapper may equally apply to cartridges comprising a permeable pouch or a perforated container at least in some configurations. Any aspects of the disclosure described in relation a cartridge comprising a permeable pouch may equally apply to cartridges comprising a wrapper or a perforated container at least in some configurations. Any aspects of the disclosure described in relation a cartridge comprising a perforated container may equally apply to cartridges comprising or a wrapper or a permeable pouch at least in some configurations.

Figure 5:
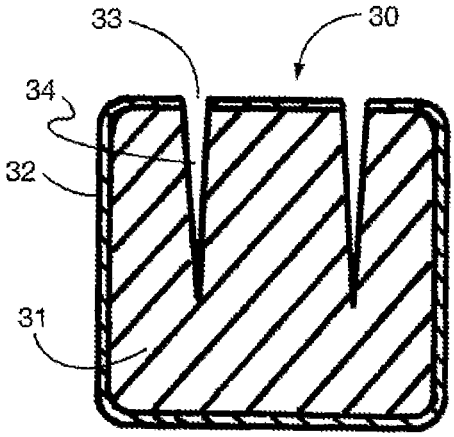
FIG. 5 is a sectional detail view of a cartridge.
Figure 6:
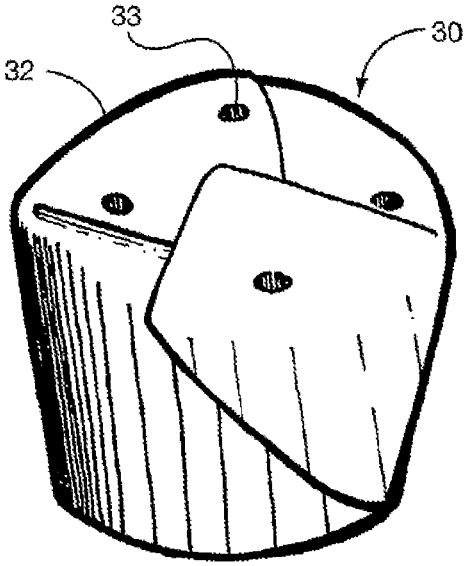
FIG. 6 is a perspective view of a cartridge.

FIG. 5 depicts a sectional view of an example of a cartridge 30. The cartridge consists of a smokeable material 31, enclosed in a wrapper 32, with perforations 33, and aeration wells 34. The wrapped cartridge allows for the easy insertion and disposal of smokeable material (e.g., tobacco material, botanicals, or any other smokeable material herein) without creating a mess, while the perforations allow the formed vapor to be released. When the cartridge is used up it can be easily disposed of in its entirety.

Smokeable material, such as, for example, tobacco or tobacco material, may be any combination of natural and synthetic material that can be vaporized for pleasure or medicinal use. In an example, a test cartridge is prepared using flue-cured tobacco, glycerin, and flavorings. Those skilled in the art of tobacco product manufacture are familiar with these and other ingredients used for cigarettes, cigars, and the like. The cartridge is produced by chopping tobacco into fine pieces (less than 3 mm diameter, preferably less than 2 mm; having no dimension larger than 3 mm, or having substantially all fine pieces be less than 2 mm in all dimensions), adding the other ingredients, and mixing until even consistency is achieved.

The cartridge may be substantially cylindrical. In other implementations, the form can be modified for various reasons. As an example, the walls of the cartridge may be drafted for easier insertion into the vaporization chamber. Or, the bottom of the cartridge may possess receptacles, which when combined with complimentary features on the surface cavity of the vaporization chamber may allow for more surface contact and hence improved thermal conduction. The wrapper may be formed as a pouch in some implementations.

Any material may be used for the wrapper, provided that when heated to the operating temperature, it does not produce significant amounts of harmful gases. Aluminum foil and parchment paper are two examples. With papers, the cartridge may be manufactured in a folded-cup design, similar to that shown in FIG. 6. With films or metal foils, the wrapper can be pressed or blow-molded to the appropriate shape.

During manufacture, the cartridge may be enclosed on all sides, and perforated on the top so that vapors can emanate upwards. In the perforation step, or in an additional step, the optional aeration wells may be created.

Figure 7:
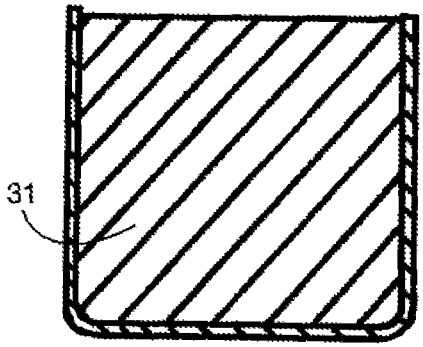
FIG. 7 is a sectional detail view of a cartridge.

The cartridge may be wrapped on all sides but leaving the top exposed, as shown in FIG. 7. This is possible since the purpose of the wrapper is primarily to prevent tobacco material from touching the sides and bottom of the vaporization chamber.

In another implementation, the material for the top of the cartridge may be vapor permeable, such that perforations are not necessary. As described in greater detail elsewhere herein, cartridges of the disclosure may also be air permeable. Such air and vapor permeable cartridges may advantageously be used to enhance air and vapor transfer along one, two or more (or all) surfaces of the cartridge.

In another implementation, the cartridge as purchased by the user has no openings, but is punctured prior to insertion into the device, or upon introduction to the vaporization device. The latter can be achieved by adding a hollow puncturing means to the mouthpiece part of the device. For example, the inhalation passage of the mouthpiece can be extended by a hollow tube. When the mouthpiece is reinserted to close the device, it pierces the cartridge previously introduced, and allows a path for vapor to exit to the user.

Figure 8:
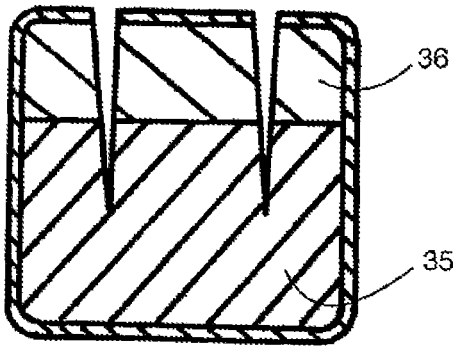
FIG. 8 is a sectional detail view of a cartridge.

In some examples, the tobacco material may be a homogenous mixture. In other examples, there may be two layers, as shown in FIG. 8. The moist layer 35 has higher content of vapor-forming material than the dry layer 36, which consists of dry tobacco or other material acting as a filter. The dry layer serves to prevent any liquid from bubbling up and out of the cartridge during heating.

In some examples, a lower compartment may consist entirely of a vapor-forming medium, such as glycerin. An upper region may consist of the tobacco material to be vaporized, and the two may be separated by a material that only allows the medium to pass in a vapor or gaseous phase. Gore-tex (brand name) is one such material. In use, vapor generated in the lower region may pass through the semi-permeable membrane, volatize the active components of the tobacco, and a mix of the two may be delivered to the user upon inhalation.

In some implementations, the consistency of the tobacco material is such that the wrapper is not necessary. This is possible if at least the outer surface of the cartridge is dry and cohesive enough to not leave deposits inside the device. Such a cartridge can be made by forming tobacco material in a mold. If the resulting surface is excessively moist, it can be dried by heating the cartridge in an oven.

The cartridge 30 may comprise a permeable pouch containing a smokeable material, The permeable pouch may comprise cellulose and/or other permeable materials (e.g., other fibers) capable of withstanding the operating temperatures of the device. The permeable pouch may comprise a binding agent or binder (e.g., cellulose acetate fibers). The binding agent or binder may be capable of withstanding the operating temperatures of the device (e.g., during heating of the smokeable material in the permeable pouch) without vaporizing ("off-gassing"). The binding agent may be safe for inhalation by a user. Thus, the permeable pouch may be capable of withstanding the operating temperatures of the device (e.g., during heating of the smokeable material in the permeable pouch) while remaining intact. The permeable pouch may be heat-sealed (e.g., at a temperature of about or exceeding the operating temperature of the device). The permeable pouch may be permeable to air, and/or vapor (e.g., vapor generated from heating the smokeable material). The permeable pouch may contain a given quantity of smokeable material. The given quantity of smokeable material may be chosen based on device dimensions, duration of smoking time, or desired smoke or vapor composition.

The cartridge 30 may comprise a perforated container containing a smokeable material, The perforated container may comprise a metallic foil with a perforation pattern on at least one surface. The perforated container may be welded shut or the perforated container may comprise a binding agent or binder (e.g., cellulose acetate fibers). The binding agent or binder may be capable of withstanding the operating temperatures of the device (e.g., during heating of the smokeable material in the perforated container) without vaporizing ("off-gassing"). The binding agent may be safe for inhalation by a user. Thus, the perforated container may be capable of withstanding the operating temperatures of the device (e.g., during heating of the smokeable material in the perforated container) while remaining intact. The perforated container may be heat-sealed (e.g., at a temperature of about or exceeding the operating temperature of the device) or welded. The perforated container may allow passage to air, and/or vapor (e.g., vapor generated from heating the smokeable material). The perforated container may contain a given quantity of smokeable material. The given quantity of smokeable material may be chosen based on device dimensions, duration of smoking time, or desired smoke or vapor composition. The perforated container may be formed as a pouch in some implementations.

Figure 9:
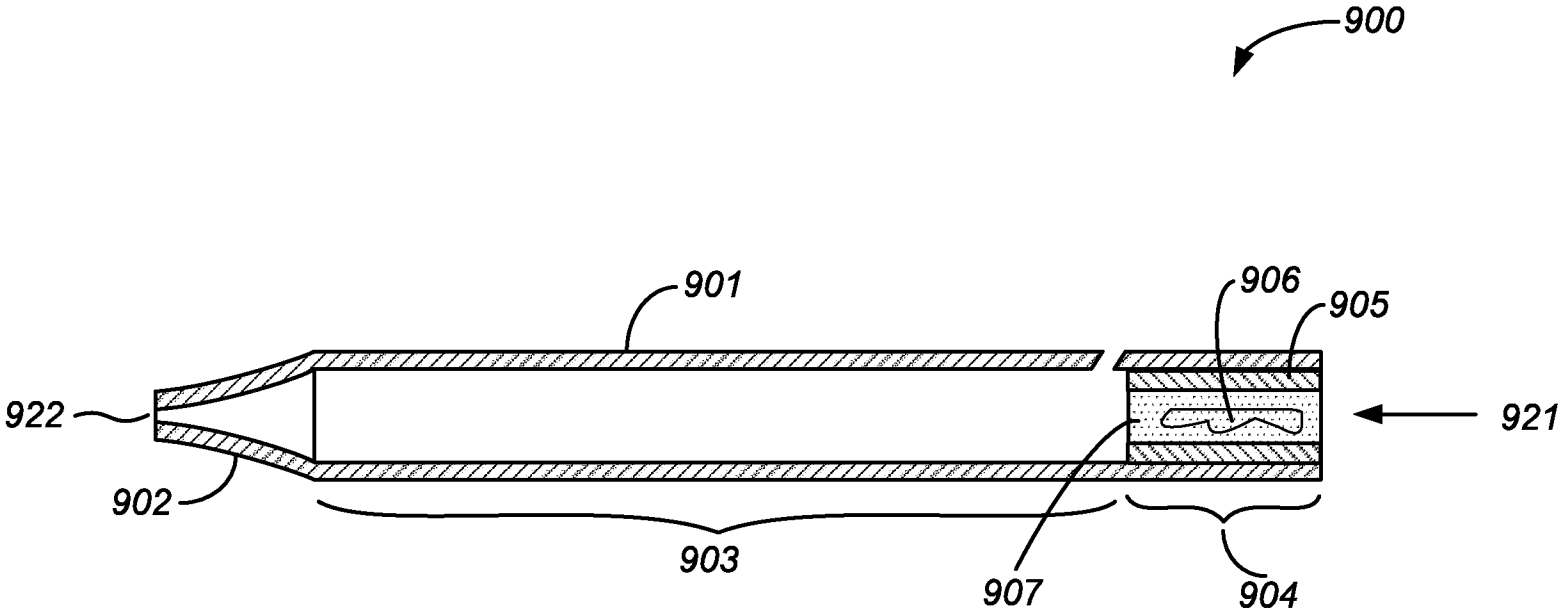
FIG. 9 is an example of a pouch in a vaporization device.

FIG. 9 is an example of a pouch 906 containing a smokeable material, fitted in a vaporization device 900. In this example, the device comprises a body 901. The device may comprise a mouthpiece 902 with an aerosol outlet 922, a condenser 903, a heater 905, and an oven or vaporization region 904. The oven region 904 may comprise an oven or vaporization chamber 907. Air may be drawn into the device through the air inlet 921 by a user puffing on the mouth piece. The pouch 906 may be placed in the oven region 904, where it may be heated by the heater 905 to generate a vapor or aerosols of the smokeable material. The pouch may comprise a permeable material or a thermally conductive material with a perforation pattern. Permeability of the pouch by means of composition of a permeable material or perforations may improve heat and mass transfer to the smokeable material in the pouch (e.g., eliminate the need for aeration vents in the oven region 904).

Figure 10:
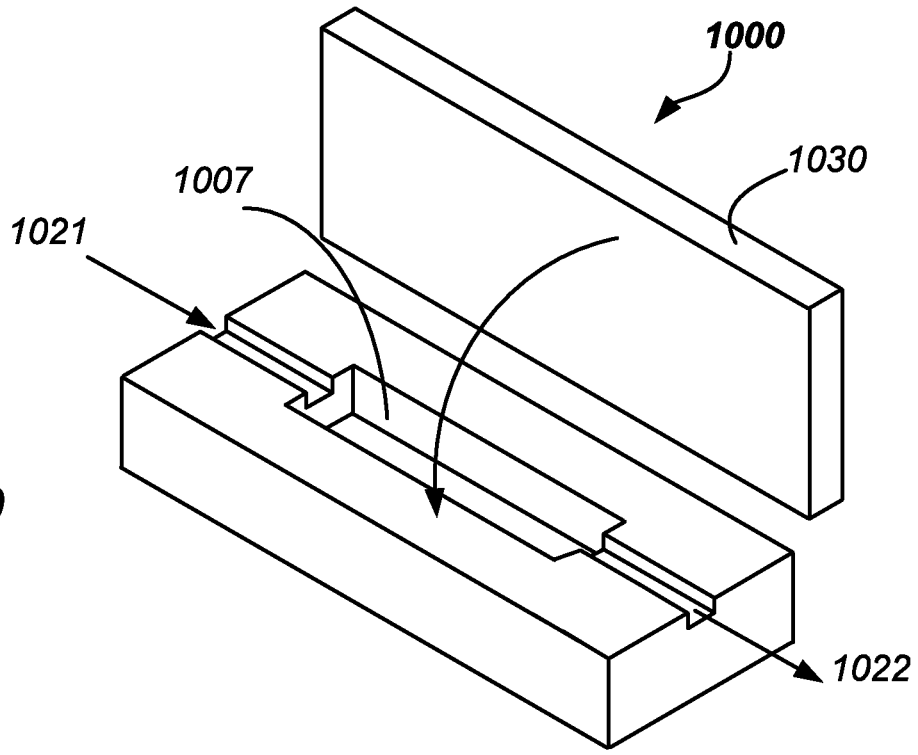
FIG. 10 is an example of an oven chamber of a device.

FIG. 10 shows an example of an oven region 1000 of a device. The oven region may comprise an oven chamber 1007 designed to fit a cartridge comprising a pouch (e.g., a permeable pouch). The pouch may comprise a permeable material or a thermally conductive material with a perforation pattern. The oven chamber may have a lid 1030 so that the user may access the oven region to insert and remove cartridges. Air may be drawn in to the oven region through an inlet 1021 and exit the oven region through an outlet 1022. Vapor generated from the heating of the smokeable material in the pouch may exit the oven region through an outlet 1022. The air may mix with vapor generated from the heating of the smokeable material. The mixing may take place in the oven chamber 1007, and the combined gas stream may exit through the outlet 1022. Permeability of the pouch by means of composition of a permeable material or perforations may improve heat and mass transfer to the smokeable material in the pouch (e.g., eliminate the need for aeration vents in the oven region 1000).

In some implementations, devices comprising a vaporization chamber configured to fit a pouch (e.g., as shown in FIGS. 9 and 10) may advantageously be used with a pouch that is permeable all around. In some examples, more efficient vapor removal may be achieved with an air path that traverses the pouch, as shown in FIGS. 9 and 10. In some implementations, greater flexibility for the device design may be realized as a result of improved air flow and vapor removal. For one example, the air inlet 22 in FIG. 2 may be provided on the mouthpiece 11 in an alternative configuration. In another example, the air inlet may be configured separately from the mouthpiece, as shown, for example, in FIG. 9.

It is to be understood that the terminology used herein is used for the purpose of describing specific embodiments, and is not intended to limit the scope of the present invention. It should be noted that as used herein, the singular forms of "a", "an" and "the" include plural references unless the context clearly dictates otherwise. In addition, unless defined otherwise, all technical and scientific terms used herein have the same meaning as commonly understood by one of ordinary skill in the art to which this invention belongs.

While preferable embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An apparatus comprising:

a cartridge comprising a perforated container containing a vaporizable material, the perforated container having two or more perforated surfaces configured to allow gas transfer through the perforated container between the two or more perforated surfaces, the gas transfer comprising entry of air into the perforated container and exit of the air and a vapor generated by heating the vaporizable material; and a device comprising:

an oven region comprising an oven chamber configured to surround the perforated container and heat the vaporizable material in the perforated container;

an air inlet through which air is drawn into the oven region;

an airflow path that traverses the perforated container between the two or more perforated surfaces; and a mouthpiece comprising an aerosol outlet configured to deliver, to a user puffing on the mouthpiece, a mixture of the air and the vapor generated by heating the vaporizable material, the air and the vapor generated by heating the vaporizable material being mixed in the oven chamber before exiting the oven region.

2. The apparatus of claim 1, wherein the perforated container comprises cellulose.

3. The apparatus of claim 1, wherein the perforated container is configured to remain substantially intact during the heating of the vaporizable material in the perforated container.

4. The apparatus of claim 1, wherein the perforated container comprises a binding agent.

5. The apparatus of claim 4, wherein the binding agent is configured to remain substantially intact during the heating of the vaporizable material in the perforated container.

6. The apparatus of claim 1, wherein the perforated container is heat-sealed.

7. The apparatus of claim 1, wherein the vaporizable material comprises a vapor forming medium.

8. The apparatus of claim 7, wherein the vapor forming medium comprises glycerin.

9. The apparatus of claim 1, wherein the device is configured to heat the vaporizable material to a temperature required to vaporize the vaporizable material.

10. The apparatus of claim 1, wherein the device is configured to heat the cartridge to a temperature below about 400° F.

11. The apparatus of claim 1, wherein the vaporizable material comprises tobacco.

12. The apparatus of claim 1, wherein the vaporizable material comprises botanicals.

13. The apparatus of claim 12, wherein the vaporizable material comprises *cannabis*.

14. The apparatus of claim 1, wherein the vaporizable material comprises fine pieces of the vaporizable material.

15. The apparatus of claim 1, wherein the vaporizable material comprises loose leaves of the vaporizable material.

16. The apparatus of claim 1, wherein the perforated container encloses the vaporizable material on all surfaces of the vaporizable material.

17. The apparatus of claim 1, wherein the two or more perforated surfaces are on different sides of the perforated container.

18. The apparatus of claim 1, wherein the perforated container comprises a permeable material comprising fibers.

19. The apparatus of claim 1, wherein the perforated container comprises cellulose acetate fibers.

20. The apparatus of claim 1, further comprising a battery-powered electric heater.

21. The apparatus of claim 1, wherein the oven chamber includes a lid to access the oven chamber to insert and remove the perforated container.

22. The apparatus of claim 21, wherein the lid comprises the mouthpiece.

23. The apparatus of claim 1, wherein the perforated container further comprises at least one aeration well, the at least one aeration well and the perforations together allowing the air to enter the perforated container and the air and vapor generated by heating the vaporizable material to exit the perforated container.

24. The apparatus of claim 1, wherein the perforated container is pre-perforated with the perforations prior to use such that the perforated container does not require being punctured during use.

25. The apparatus of claim 1, further comprising a condenser.

26. The apparatus of claim 1, wherein the perforated container is welded shut.

27. A cartridge configured for use in a vaporizer device comprising an oven chamber, the cartridge comprising:

a perforated container having two or more perforated surfaces; and a vaporizable material within the perforated container;

wherein the perforations allow gas transfer that traverses the perforated container between the two or more perforated surfaces, the gas transfer comprising entry of air into the perforated container and exit of the air and a vapor generated by heating the vaporizable material when the cartridge is placed in the oven chamber.

28. The cartridge of claim 27, wherein the perforated container is pre-perforated with the perforations such that the perforated container does not require being punctured during use.

29. The cartridge of claim 27, wherein the vaporizable material comprises tobacco.

30. The cartridge of claim 27, wherein the perforated container is welded shut, heat-sealed, or sealed with a binding agent.

31. A device for use with a cartridge comprising a perforated container containing a tobacco material, the perforated container having two or more perforated surfaces, the device comprising:

an oven region comprising an oven chamber configured to surround the perforated container and heat the vaporizable material in the perforated container;

an air inlet through which air is drawn into the oven region;

an airflow path via which the air traverses the perforated container between the two or more perforated surfaces;

a condenser; and a lid to access the oven chamber to insert and remove the perforated container, the lid comprising a mouthpiece comprising an aerosol outlet configured to deliver, to a user puffing on the mouthpiece, a mixture of the air and the vapor generated by heating the vaporizable material, the air and the vapor generated by heating the vaporizable material being mixed in the oven chamber before exiting the oven region.

32. The device of claim 31, wherein the two or more perforated surfaces are on different sides of the perforated container.

33. The cartridge of claim 27, wherein the two or more perforated surfaces are on different sides of the perforated container.

* * * * *